United States Patent [19]

Lancaster et al.

[11] Patent Number: 4,676,048

[45] Date of Patent: Jun. 30, 1987

[54] SUPPLY CONTROL ROTATING STRETCH WRAPPING APPARATUS AND PROCESS

[75] Inventors: Patrick R. Lancaster; William G. Lancaster, both of Louisville, Ky.

[73] Assignee: Lantech, Inc., Louisville, Ky.

[21] Appl. No.: 867,006

[22] Filed: May 20, 1986

Related U.S. Application Data

[63] Continuation of Ser. No. 582,797, Feb. 23, 1984, abandoned.

[51] Int. Cl.[4] ..... B65B 13/04

[52] U.S. Cl. ..... 53/399; 53/441; 53/556; 53/588; 53/210; 53/465

[58] Field of Search ..... 53/399, 441, 465, 556, 53/587, 586, 210, 211

[56] References Cited

U.S. PATENT DOCUMENTS

| | | | |
|---|---|---|---|
| 4,317,322 | 3/1982 | Lancaster | 53/588 X |
| 4,387,548 | 6/1983 | Lancaster | 53/465 X |
| 4,418,510 | 12/1983 | Lancaster | 53/399 |

*Primary Examiner*—John Sipos

*Attorney, Agent, or Firm*—Finnegan, Henderson, Farabow, Garrett and Dunner

[57] ABSTRACT

A rotatable film wrapping apparatus for wrapping a load on a conveyor with an overwrap of stretched plastic film web, having a ring-mounted film web pre-stretch mechanism which stretches and dispenses film at a varying speed controlled independently of variations in film tension and speed between the pre-stretch mechanism and the load, and a supply speed control mechanism which varies the supply speed of web from the pre-stretch mechanism as the ring rotates. The supply speed control mechanism is configured as a predetermined model of the load to minimize variation in film elongation and containment as successive load edges intercept film web during wrapping, thereby locking in these characteristics at predetermined levels for film web wrapped across the load side which ends at the edge. The pre-stretch mechanism comprises a downstream roller across which the film is drawn at a speed which varies, an upstream roller engaging the film and linked by gears to the downstream roller so that the upstream roller rotates at a fixed fraction of the downstream roller speed to stretch film between the rollers, and a power pulley or roller which extends to one side of the pre-stretch mechanism and engages the supply speed control mechanism to accelerate and decelerate the upstream and downstream rollers. Because the supply speed control mechanism drives the pre-stretch mechanism independently of the moving film web, tension reductions in the web caused by holes at web imperfections do not slow or stop the pre-stretch mechanism, so that holes move to the load without expansion and web destruction. The supply speed control mechanism overcomes rotational inertia of the film roll and pre-stretch mechanism to accelerate and decelerate film supply without delay caused by inertia.

37 Claims, 18 Drawing Figures

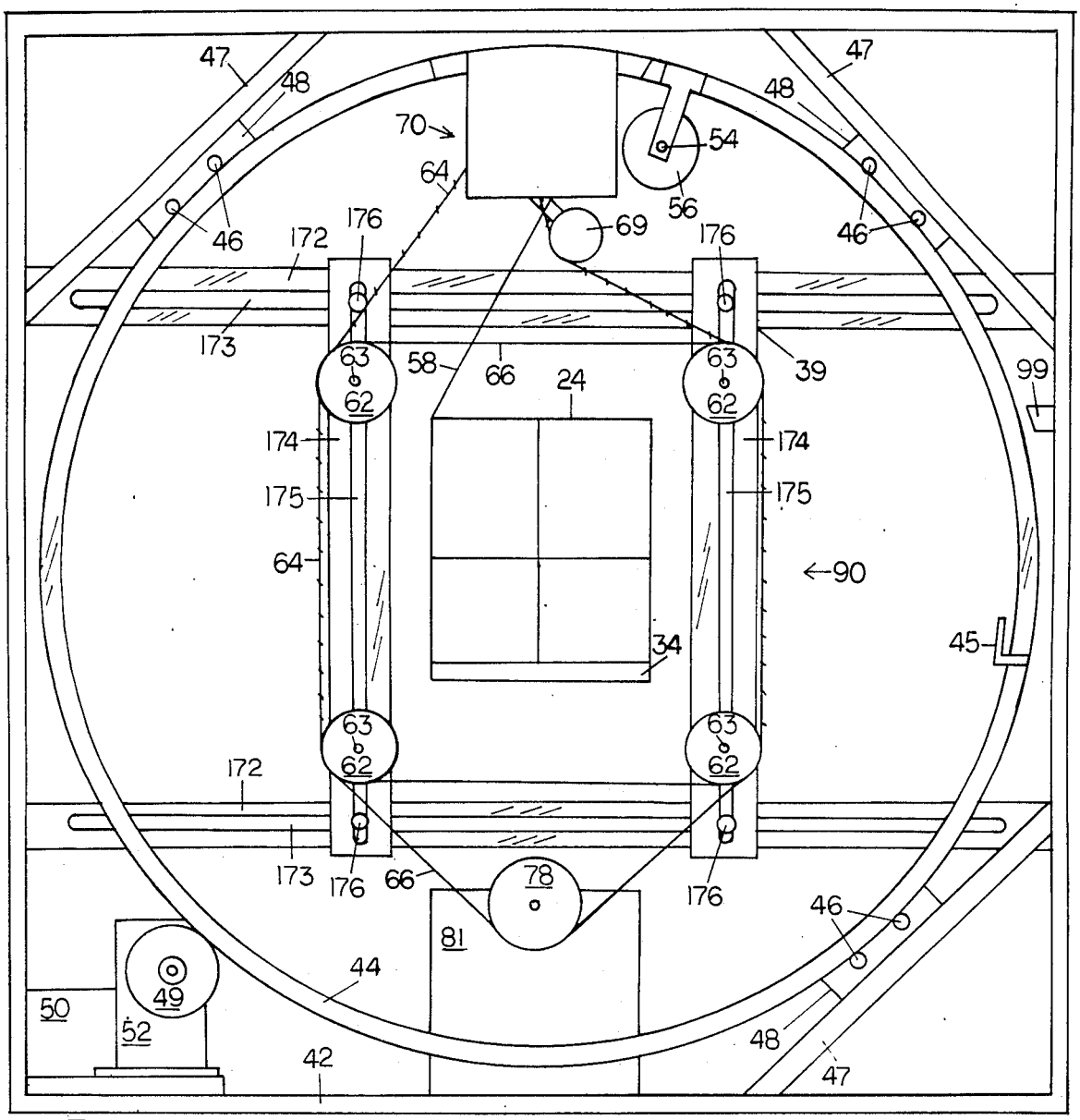
FIG 3
FIG 10
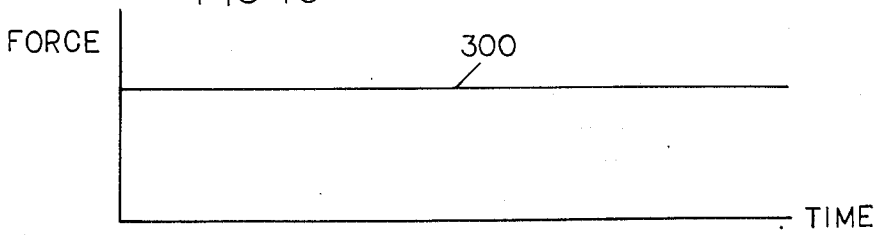

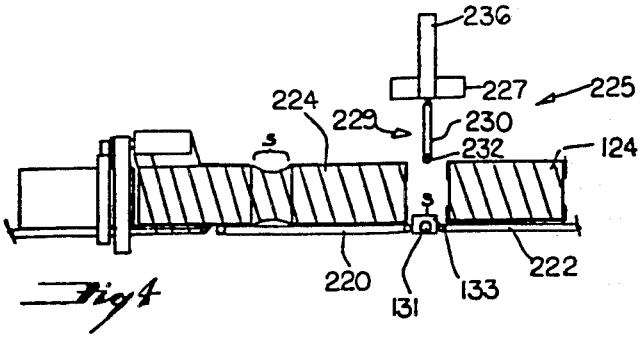
Fig 4
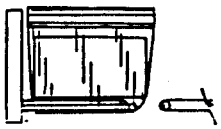
Fig 16
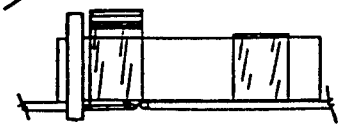
Fig 17
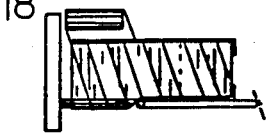
Fig 18
FIG 12
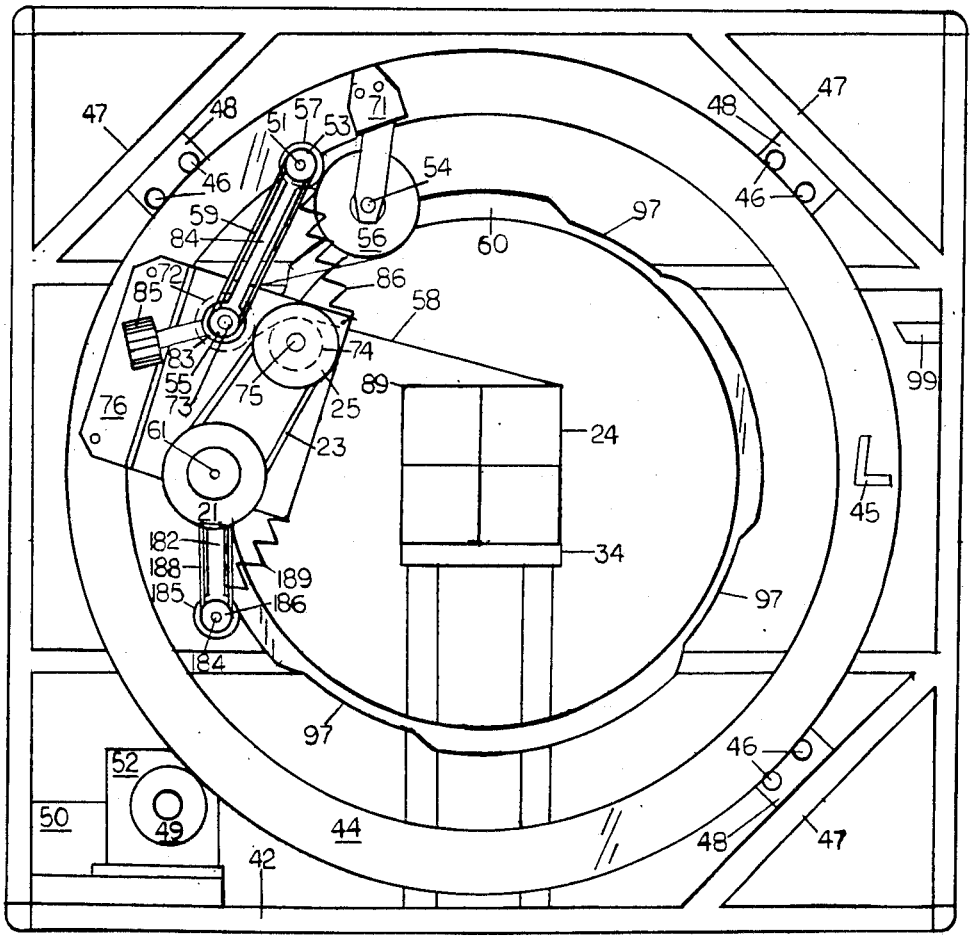

SUPPLY CONTROL ROTATING STRETCH WRAPPING APPARATUS AND PROCESS

This application is a continuation of application Ser. No. 582,797, filed Feb. 23, 1984 now abandoned.

BACKGROUND OF THE INVENTION

The present invention generally relates to packaging and more particularly is directed to a rotating stretch wrapping apparatus for making unitary packages which hold a plurality of components, each package containing a load wrapped in a web of stretched film.

Case packing or boxing is a common way of shipping multiple unit products. Multiple unit products are generally stacked in a corrugated box or are wrapped with kraft paper with the ends of the kraft paper being glued or taped.

Some manufacturers use strapping of vertical steel or plastic binding to unitize the product. The problems incurred in the use of strapping are the requirement of costly corner protectors, danger of bending or snapping and injuring the operator while applying this high tension material to the loads, the ever present settling due to moisture wetting the cartons, and the sides bulging or normal vibrations causing the straps to loosen and the load to come apart.

Glue is an alternative method used in some areas, but customers are dissatisfied with gluing because removal of glued cartons or bags from the unitized loads tends to tear outside layers of the cartons. Glue, although an inexpensive material, demands interleaving for product orientation and thus requires more durable and expensive packaging material.

Because of the lack of alternatives of packaging, tape is currently being used to horizontally bind the top layer of the load. However, tape is expensive and allows relatively free movement of all products surrounded.

Another way of shipping products is by putting a sleeve or covering of heat shrinkable material around the products and shrinking the sleeve to form a unitized package. The use of heat shrinkable film is described in U.S. Pat. Nos. 3,793,798; 3,626,645; 3,590,549 and 3,514,920. A discussion of this art is set forth in U.S. Pat. No. 3,867,806.

An economical way of packaging products is by wrapping the product load with a web of stretched plastic film.

The elasticity of the stretched plastic film holds the products of the load under more tension than either shrink wrap or kraft wrap, particularly with products which settle when packaged. The effectiveness of stretched plastic film in holding a load together is a function of the containment or stretch force being placed on the load and the ultimate strength of the total layered film wrap. These two functions are determined by the modulus or hardness of the film after stretch has occurred and the ultimate strength of the film after application. Containment force is currently achieved by maximizing elongation until just below a critical point where breaking of the film occurs.

The use of wrapping machinery to wrap stretched film around a load is well known in the art. Four types of stretch wrapping apparatus are commonly used in the packaging industry and these types are generally described as spiral rotary machines, full web rotary machines, passthrough machines, and circular rotating machines.

A typical spiral machine is shown in U.S. Pat. No. 3,863,425 in which film is guided from a roll and wrapped around a load in a spiral configuration. A carriage drives the film roll adjacent the surface of the load to deposit a spiral wrap around the load and returns in the opposite direction to deposit another spiral wrap around the load.

Spiral wrapping machines which are currently commercially available are manufactured by Lantech, Inc. under Model Nos. SVS-80, SVSM-80, STVS-80, STVSM-80 and SAHS-80.

A full web type of apparatus which wraps stretched film around a rotating load is disclosed in U.S. Pat. No. 3,867,806 assigned to Lantech, Inc. A similar full web apparatus using a tensioned cling film wrapped around a rotating load is shown by U.S. Pat. No. 3,986,611 while another apparatus using a tacky PVC film is disclosed in U.S. Pat. No. 3,795,086.

Full web wrapping machines typical of those presently commercially available are Model Nos. S-65, T-65 and SAH-70 manufactured by Lantech, Inc.

Another type of machine for wrapping a pallet load commonly called a passthrough machine is disclosed in U.S. Pat. No. 3,596,434. In this reference a pallet load is transported along a conveyor and the leading face of the pallet load contacts a vertical curtain of film formed by the sealed leading edges of film webs dispensed by two rolls of film on opposite sides of the path of the pallet load. The pallet load continues to move along the conveyor, carrying with it the sealed film curtain until the two side faces of the pallet load as well as the front face are covered by film web. A pair of clamping jaws then close behind the pallet load, bringing the two film web portions trailing from the side faces of the pallet load into contact with one another behind the pallet. The jaws then seal the film web portions together along two vertical lines, and cut the web portions between those two seals. Thus, the film web portions are connected to cover the trailing face of the pallet load, and the film curtain across the conveyor is re-established to receive the next pallet load. The pallet load may subsequently be exposed to heat in order to shrink the film web thus applying unitizing tension to the load, as is disclosed in U.S. Pat. No. 3,662,512. Commercial passthrough machines are currently manufactured by Weldotron, Arenco, and SAT of France.

Various apparatus and processes have been developed to rotatably wrap stacked components to form a load.

Stationary loads which are brought to a loading area and are wrapped by a rotating member dispensing stretched film are disclosed in U.S. Pat. Nos. 4,079,565 and 4,109,445. U.S. Pat. No. 4,079,565 discloses a full web vertical wrap of the load while U.S. Pat. No. 4,109,445 discloses the horizontal spiral wrap of a load. U.S. Pat. No. 4,050,220 discloses a wrapping device for multiple unit loads. Each load is conveyed to a wrapping area in which a load is supported on one or more stationary planar surfaces. The leading edge of a roll of stretchable plastic wrapping material is held adjacent to the load, and the roll or material is rotated about the load and the supporting planar surfaces beneath the load, wrapping the load and the supporting surfaces together. Plastic wrapping material is stretched during the wrapping operation so that the material is under tension when applied to the load. After the wrapping cycle is complete, the load is pushed past the ends of the supporting surfaces, and the wrapping material which covered the supporting surfaces collapses against the supported sides of the load. Further developments of this wrapping system are disclosed in U.S. Pat. Nos. 4,110,957 and 4,178,734.

U.S. Pat. No. 603,585 discloses a spiral wrapping device for enclosing individual newspapers in paper wrap for mailing purposes.

Each newspaper is placed on a cylindrical core with a circumference approximately twice that of a newspaper, and each newspaper advances along the length of the core as the core is rotated. Wrapping paper is applied to the core at an angle and the wrapping paper between newspapers is severed as each newspaper reaches the end of the cylinder and is placed on a flat horizontal surface, thereby collapsing the wrapping paper against the underside of the newspaper previously pressed to the cylinder.

U.S. Pat. No. 1,417,591 discloses a wrapping machine for individual items such as boxes in which each such item is conveyed along the surface of a horizontal sheet of wrapping material. The edges of wrapping material on each side of an item are curled upward to meet one another atop the item to be wrapped thereby forming a tube around the item. The leading end of the tube is sealed and the trailing end of the tube is severed and then sealed to enclose the item. Another device which utilizes this system of wrapping is disclosed in U.S. Pat. No. 3,473,288.

In U.S. Pat. No. 2,575,467, a wrapper of cylindrical packages for material such as sausage is disclosed in which the package is rotated about its cylindrical axis as wrapping tape is applied at an angle to form a cylindrical wrap.

In U.S. Pat. No. 2,863,270, two cylindrical items of approximately equal diameter are abutted at their planar ends, and placed by hand in a cradle which exposes the complete circumference of the abutting ends. A roll of wrapping material is then driven by a hand crank mechanism to circulate around the circumference of the abutting ends, applying wrapping material thereto. When sealed together, the pair of cylindrical items are removed from the cradle by hand.

A spiral wrapping machine for long bundles of items such as filaments is disclosed in U.S. Pat. No. 3,000,167. As the bundle of filaments moves along its axis through the wrapping area, a ring circulates about the bundle carrying a roll of wrapping material which is applied to the bundle to form a spiral wrap pattern. Because the normal load of filaments or similar items is much longer than the wrapping area, it is not necessary to provide support for the bundle in the wrapping area, and therefore no support structure is wrapped with the bundle.

All of these prior art apparatuses suffer from a severe limitation which relates to cost per unit load for film unitization. Friction brake devices do not maintain a consistent stretch force on the film. These brake devices are subject to variation due to their physical construction, sensitivity to speed change caused by passage of load corners, and the resultant sudden acceleration and deceleration of film payout. A typical load will incur a surface speed change of more than 40% with each quarter turn, and each quarter turn occurs in about ½ second under current practice. Moreover, it can be appreciated that these speed changes are substantially discontinuous as film dispensed by relative rotation of the film roll around the load is intercepted by successive edges of the load. Higher rotation speeds produce additional resonating forces which change during payout and the resultant weight decrease of the film roll. Additional limitations on maximum elongation are caused by film roll imperfections and gauge variations which accentuate the force variations described above to produce film ruptures.

Commercial circular rotating wrapping machines are presently manufactured by Lantech, Inc. under the trademark LANRINGER, and are provided with wrapping ring inner diameters of 36 inches, 54 inches, 72 inches, and 84 inches. In differentiating between the various circular rotating wrapping machines manufactured by Lantech, Inc., the manual model has the designation SR; the full web models have the designations SVR and SAVR; the multiple banding models have the designation SVBR and SAVBR; the spiral models have the designation SVSR and SAVSR, and the continuous wrap or bundler models have the model designations SVCR and SAVCR.

U.S. Pat. Nos. 4,302,920 and 4,317,322, assigned to Lantech, Inc., disclose a pre-stretch film elongation system mounted adjacent a film roll and rotated about a stationary load. The pre-stretch system which is mounted on the rotating ring includes an upstream roller and a downstream roller across which the film web successively passes. The two rollers are coupled by gears, belts, or the like, which force a constant ratio of velocity between the rollers. Film is drawn from the film roll and across each of the rollers by relative rotation of the ring around the load. The fixed speed ratio between the upstream and downstream rollers, in which the downstream roller moves more quickly than the upstream roller, causes substantial and constant stretching between the rollers of the web. In this device the substantial changes in demand speed are transmitted directly from the load back through the web to the pre-stretch device, so that the supply speed of the film moving across the downstream roller to the load changes accordingly. However, it can be appreciated that the entire force exerted between the rollers is applied to the rollers by film being wrapped about the load, and that pre-stretch device inertia and the elasticity of film web between the downstream roller and the load causes a phase delay or lag in supply speed changes. It has also become clear that any hole in the web, such as those which commonly occur at web imperfections or guage variations, causes a weakening between the load and the pre-stretch mechanism, thus slowing or stopping the pre-stretch mechanism. The hole is then elongated and enlarged by the growing difference between supply and demand speeds, finally breaking the film web and interrupting the wrapping procedure.

Furthermore, it has been discovered that two characteristics of the film wrapping systems described above combine after wrapping is completed to reduce the containment force exerted on the load. One such characteristic is that a film web segment applied to any one side of the load exhibits elongation and containment force independent of contiguous film web applied to either of the sides immediately prior to or after the given side. This is because load edges isolate each film web segment applied to a side from connecting film web segments applied to adjacent sides, so that slippage across edges does not occur. Film web characteristics are thus effectively "locked in" on each side as the film web encounters the edge at the end of the side.

The second characteristic is that, in prior art wrapping systems, locking in at load edges occurred precisely at the point where the film web experienced a minimum of force and elongation, having partly retracted and recovered from a prior maximum force/elongation point, thereby locking in the same minimum characteristics. Since a maximum force was also experienced during the wrapping of each load side, an attempt to raise overall force in order to raise the minimum point will also raise the maximum point and increase the risk of exceeding the failure point for the film web. An attempt to lower overall force for delicate loads will reduce the minimum point and risk zero containment of the load. Hence, the prior art wrapping systems are compelled to wrap stretchable film web to a load at containment force levels well below those levels theoretically possible, which, in turn, reduces the final post-unitizing force to the load after film web recovery and after shifting and settling has reduced the load circumference.

It therefore remains clear that there exists a need and use for a circular rotating wrapping apparatus and process which incorporates a pre-stretch system and avoids the force pattern which reaches a minimum as each load edge is encountered, preferably introducing a pattern which minimizes changes in force and elongation at each edge to lock in desirable web characteristics. Moreover, the apparatus and process should avoid control of the pre-stretch system through the film web itself, so that the pre-stretch system will not decelerate when holes develop in the film web. Thus the risk of hole expansion and film failure will be minimized.

SUMMARY OF THE INVENTION

The present invention is directed toward an apparatus and process for applying stretchable plastic film to loads using a pre-stretch mechanism which is driven and controlled independently of the web tension to minimize variations in the force exerted on the film web at load edges by varying the film web supply speed. Film web is drawn to the load at a demand speed which varies during rotation of a film roll about a load. The supply speed changes required to minimize web elongation and containment force changes at load edges are transmitted to the pre-stretch mechanism by a supply speed control mechanism using a predetermined model of the load, which permits higher levels of stretch, faster payout speeds, and use of less uniform film than were previously thought possible. The present invention reduces the likelihood of unexpected web breakage during wrapping, increases throughput and conserves film by establishing load containment with fewer web layers.

In the apparatus a series of loads are fed into a rotating wrapping apparatus having a film web pre-stretch mechanism and elongation drive mechanism. Each load is covered by a plurality of layers of stretched film to form a unitary package. The pre-stretch mechanism is mounted on a rotating ring through which a load travels for encirclement by stretched film web. The supply speed control mechanism is mounted adjacent the rotating ring. Energy is delivered to the pre-stretch mechanism during rotation of the rotating ring by way of a power pulley, cam follower or the like mounted to the pre-stretch mechanism. The power pulley engages the supply speed control mechanism and revolves at a varying rate due to friction thereon. The power pulley then transfers its energy and speed to the film pre-stretch mechanism. The pre-stretch mechanism is thus operated at a varying speed and supplied with the force required to stretch the film by the supply speed control mechanism.

Thus, it can be seen that the invention provides a novel and useful improvement over the prior art rotating wrapping machines, both those utilizing brake stretching systems and those utilizing coupled roller stretching systems. This is advantageously accomplished without the need to transfer electrical power or control signals from a stationary source to devices such as brakes or motors on the rotating ring.

Most plastic films when stretched above their yield point gain significantly in modulus and ultimate strength. The typical polyethylene will multiply three times the ultimate strength in pounds per square inch of cross sectional area after being elongated approximately 300 percent. This significant increase in strength begins approximately when the yield point is exceeded in the elongation phase. The term "yield point" designates a range or region on the stress-strain curve, rather than a dimensionless point. Limitations of friction-based constant force devices prevent current stretch wrap applications from achieving the higher levels of containment force and ultimate strength available in the foremost plastic films. Achieving the higher elongation levels with the invention allows wrapping with fewer revolutions of film yet maintains equivalent holding power. These higher levels of stretch not only allow fewer revolutions of film but also permit wrapping with less film by weight for each revolution.

Thus, the present invention allows at least double the practical level of elongation currently experienced with prior art "brake" systems. This gives higher containment forces and/or lower film costs to the end user.

Furthermore, the invention allows for more precise control of web speeds and forces thereby achieving greater cost efficiency from high yield films, along with higher film strength or modulus achieved at higher levels of elongation.

The novel construction of the invention provides for isolation of the pre-stretch mechanism from stretch forces which eliminates premature film failure from development and elongation of holes at web imperfections. This construction eliminates friction brakes and the problems of those brakes such as speed variation, break away from stop position, temperature variation, wear and operator control meddling.

It can thus be seen that the present invention provides a unique apparatus and process with an elongation mechanism driven to apply uniform film web containment across every side of the load. The film is preferably stretched beyond its yield point as it is accelerated. The acceleration force is provided by the supply speed control mechanism, which also precisely varies the web supply speed to lock in predetermined elongation and containment force on the load. By limiting the stretching action to a minimum distance within the elongation mechanism and avoiding secondary stretch between the elongation mechanism and the load, web neck down is significantly reduced.

Although the invention is set forth in the claims, the invention itself and the method by which it is made and used may be better understood by referring to the following description taken in connection with the accompanying drawings forming a part hereof, in which like reference numerals refer to like parts throughout the several views and in which:

BRIEF DESCRIPTION OF THE DRAWINGS

FIG. 3 is an enlarged front elevational view of the apparatus shown in Figure 1;

FIG. 4 is a side elevational view of a continuous spiral bundling system with a sequence of consecutive packages wrapped by the present invention;

FIG. 10 is a graph of force versus time for the preferred embodiment of the present inventive apparatus;

FIG. 12 is an enlarged front elevational view of an alternate embodiment of the present invention;

FIG. 16 is a side elevational view of a full web wrap mode accomplished by the present invention;

FIG. 17 is a side elevational view of a banding wrap mode accomplished by the present invention; and FIG. 18 is a side elevational view of a spiral wrap mode accomplished by the present invention.

DETAILED DESCRIPTION OF THE DRAWINGS

Figure 1:
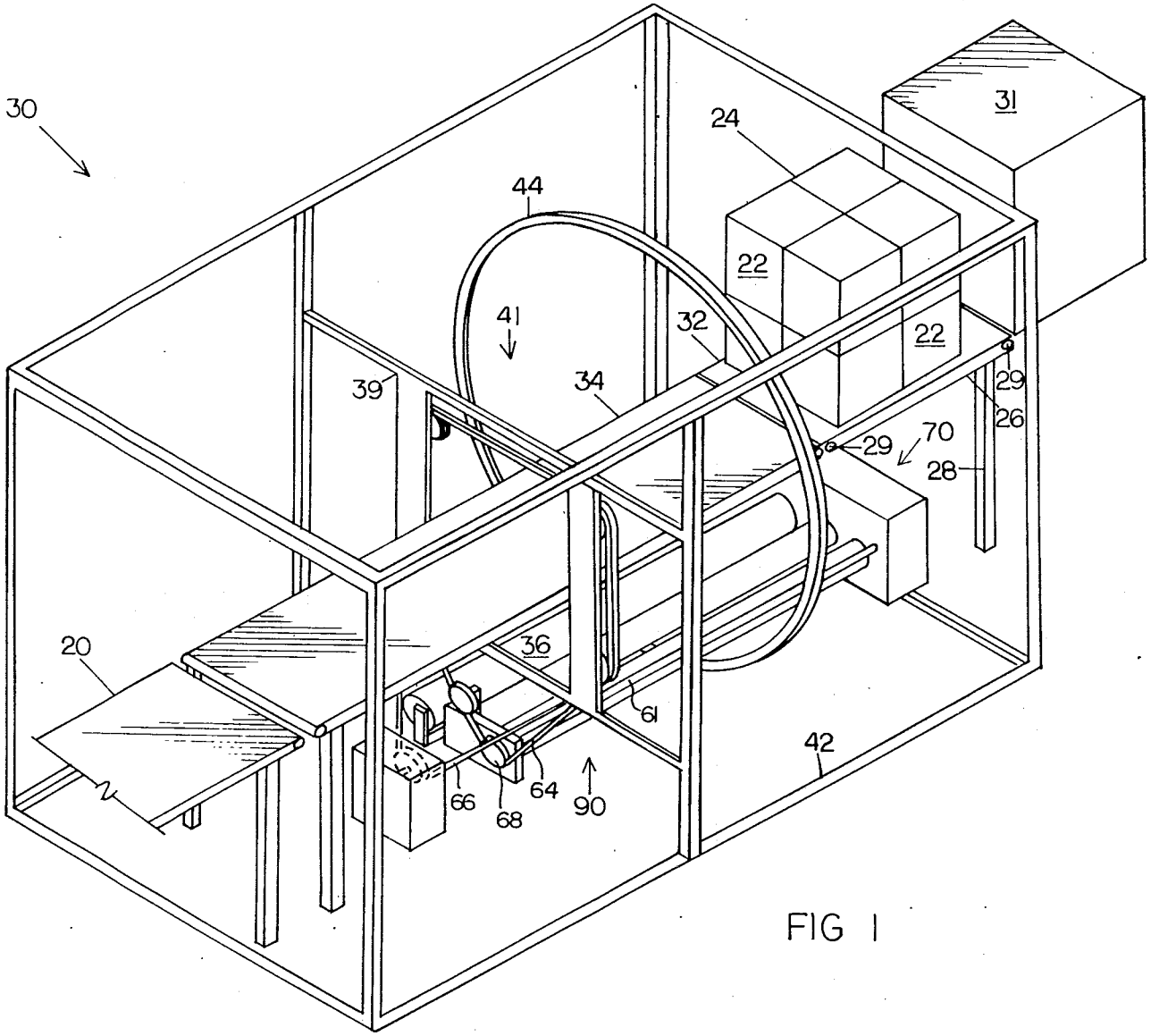
FIG. 1 is a perspective view of the invention partly broken away disclosing a preferred embodiment of the inventive apparatus.
Figure 2:
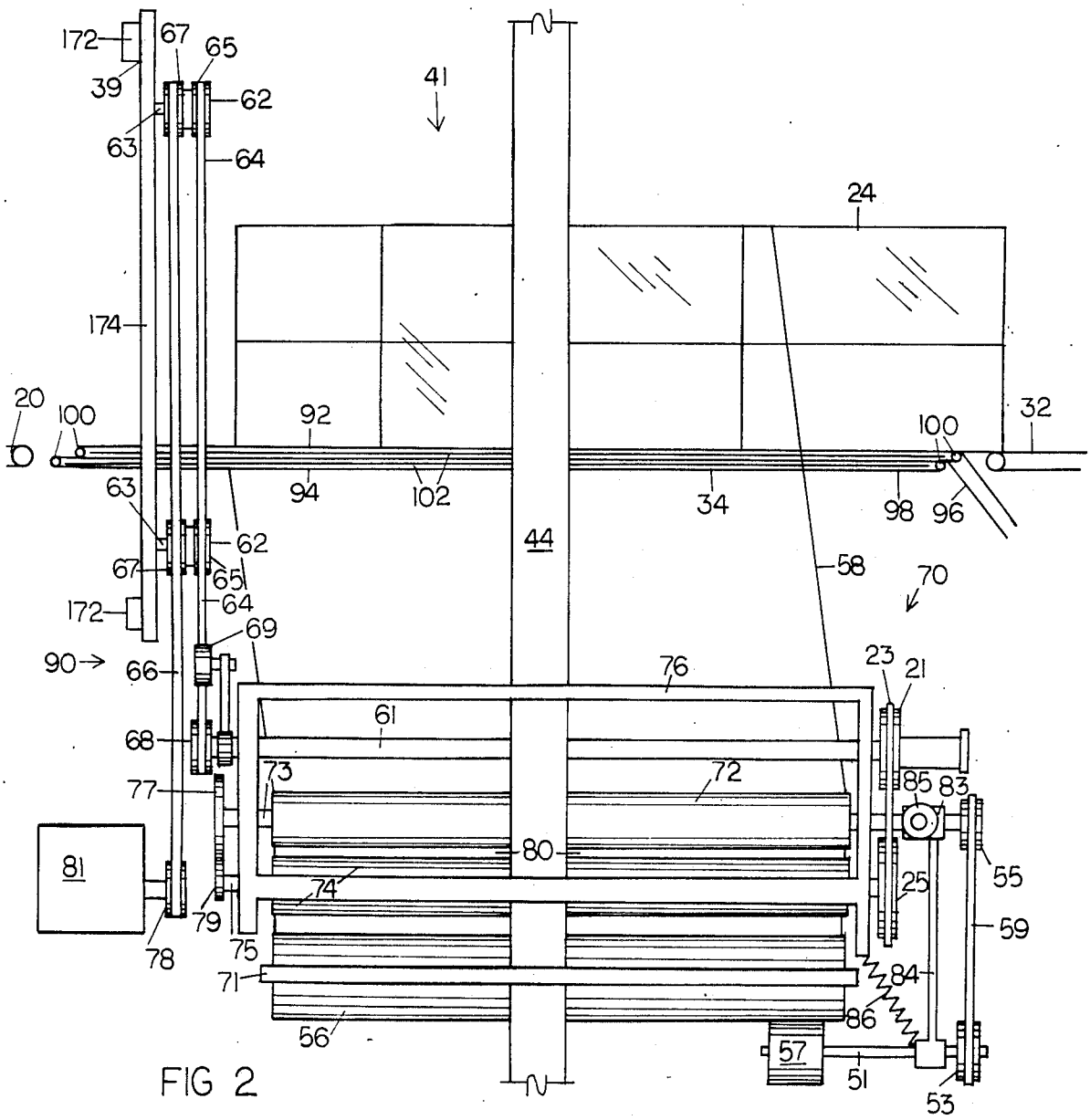
FIG. 2 is an enlarged reversed side elevational view of the apparatus shown in FIG. 1.

The best mode and preferred embodiment of the present invention is disclosed in FIGS. 1 through 3, and comprises a ring wrapping apparatus 30 comprising a feed conveyor 32, a wrap and load conveyor assembly 34, a film dispensing mechanism 36 with a take-off conveyor 20.

As shown in FIG. 1, a plurality of units 22 forming a load 24 have been loaded in a stacked relationship on an infeed conveyor assembly 32 by either manual or mechanical means. It should be noted that the load, depending on its nature and composition, may or may not require spacing. The loading device 31 is schematically shown and may be one of a number of types of stacking or placing devices which are well known in the art to place a stack of cartons or materials into designated areas.

Throughout this specification, containment force refers to force applied to a load by film web surrounding the load when wrapping is completed, while wrapping force refers to force applied by film web extending from the wrapping system to the load during wrapping. Wrapping force is, of course, applied equally and oppositely to the film web and to the load simultaneously.

In the preferred embodiment, the load 24 is placed on an infeed conveyor 2 which is comprised of an endless belt 26 mounted on frame support 28.

An alternate embodiment of the infeed conveyor could take the form of a hydraulic or pneumatic pushing device (not shown) which can be used to engage each load 24 with a platen to push the load into the wrapping area. However, the conveyor embodiment is preferred and the belts of the conveyor of the present invention are preferably textured so that they have a high coefficient of friction.

The particular arrangement of the conveyors set forth in FIGS. 1 and 2 lends itself to random variation of total load size in all three dimensions. It is apparent however that other configurations could be constructed which would be advantageous for specific products. Thus, the conveyance of twelve-packs or six-packs of cans or bottles could be handled by a horizontal conveyor with guide conveyors on each side.

The conveyor belt 26 as seen in FIG. 1 is mounted on rollers 29 which are rotatably journalled by suitable bearing means in brackets which are secured to the frame support 28. The infeed conveyor 32 carries the loads 24 onto a wrapping station 41 comprising film dispensing apparatus 36, and wrapping conveyor assembly 34.

The preferred embodiment and best mode of the invention comprises a frame 42 on which a steel "donut" or ring-shaped film support member 44 is rotatably mounted and supported on three planes by guide rollers 46. If desired, the film support member can be constructed of aluminum. A plurality of guide rollers 46 project inward from the frame 42 on arms 47 and mounting plates 48 to engage the ring-shaped member so that it can be driven in a predetermined path. A friction drive wheel 49 is positioned adjacent the ring member 44 at its base and engages the member 44 to rotate the member 44 within the guide wheel rolling area. The friction drive wheel 49 is driven by a motor 50 having a shaft which is suitably connected with a drive reducer 52. A material roll dispensing shaft 54 is rotatably secured to the ring member 44 for rotation on its axis and is adapted to receive and hold a roll of film material 56.

An important aspect of film wrapping apparatus performance is that the elongation and containment force exerted by any one layer of film applied across any given side of a load is not influenced by the characteristics of the same layer of film wrapped to either a prior side or a subsequent side of the load. Load edges are barriers preventing film slippage which would otherwise alter film elongation and containment force. In other words, film elongation and containment force are locked in for a given load side when the film encounters the edge at the end of the side. Thus, it is advantageous to increase the containment force and elongation just before the corner is encountered, in order to minimize wrapping force fluctuation and minimize the risk of film destruction due to excessive force at any other point in the wrap cycle.

Figure 7:
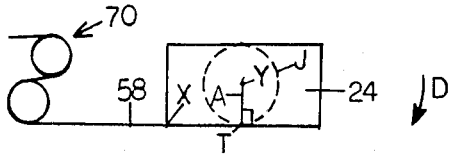
FIG. 7 is a schematic representation of film web demand during relative rotation of a load.
Figure 8:
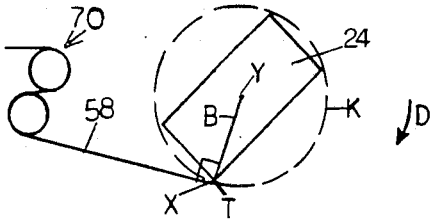
FIG. 8 is a schematic representation of film web demand at a wrapping stage on the load subsequent to that of FIG. 7.
Figure 9:
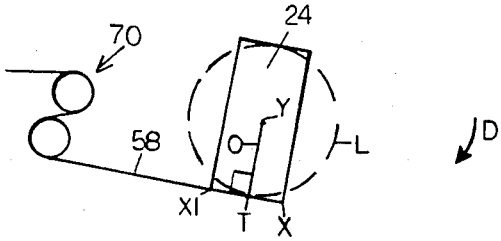
FIG. 9 is a schematic representation of film web demand at a wrapping stage on the load subsequent to that of FIG. 8.

It has been found that the prior art supply systems lock in elongation and containment force at a minimum value when each load edge is encountered. A schematic representation of film demand rate at load edges is shown in FIGS. 7 through 9 in which a pre-stretch mechanism 70 is rotated in the direction indicated by the arrow D around a center point Y at a constant angular velocity to wrap a representative rectangular load 24. In FIG. 7, the film web 58 has just completed wrapping a long side of the load and has encountered corner X. At this point the film web 58 passes on a straight line from pre-stretch mechanism 70 across the long face of the load. The line of film web 58 therefore forms a right angle with the line segment A extending from the rotation center Y to the tangent point T. At this instant, the rate of demand for film web by the load 24 during wrapping can be computed by treating the line segment A as the effective wrapping radius of a circle J to which film 58 is tangent at point T. It can readily be appreciated that the rate of demand for film will increase as the effective wrapping radius increases, under constant angular rotation of the pre-stretch mechanism 70.

Turning to FIG. 8, subsequent rotation of the pre-stretch mechanism 70 has reached the point of maximum demand rate. The tangent point T is now equivalent to the corner X, and the line segment B from the corner X to the rotation center Y defines the effective wrapping radius of a circle K. It can readily be appreciated that the radius B is much longer than the radius A, so that the film demand rate in FIG. 8 is much greater that the film demand rate in FIG. 7.

Turning to FIG. 9, further rotation of the pre-stretch mechanism 70 about the load has completed the wrapping of the short side and encountered the corner X1 subsequent to the corner X. The film web 58 now lies along the short side of the load, and the line segment C from the rotation center Y to the tangent point T defines the effective wrapping radius of a circle L. It can clearly be seen that the radius C is shorter than the prior radius B, so that the linear film demand rate at this stage in wrapping the load is less than that in FIG. 8.

Figure 5:
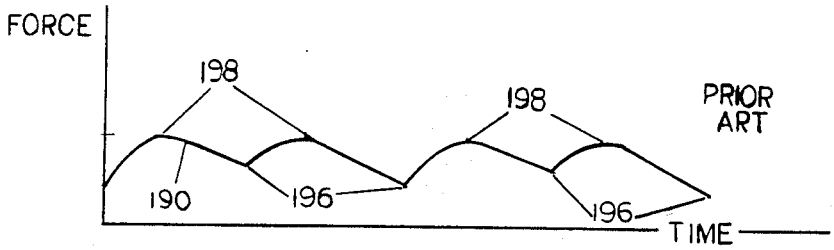
FIG. 5 is a graph of force versus time as exhibited by prior art wrapping apparatus.

To summarize, it can be appreciated that film web is demanded by the load at a rate which varies but is always at a minimum when a side is completely wrapped and a corner is encountered. This swing from minimum to maximum and back occurs once for each load side, or four times per revolution for a load of rectangular cross-section. If film web 58 is dispensed from pre-stretch mechanism 70 at a constant rate, the net film web acceleration and force will follow the same pattern of variation as the demand rate. This is illustrated in FIG. 5, in which a curve 190 shows the varying wrapping force experienced by the load as well as the film web between the load and the downstream roller of a typical prior art pre-stretch system. Each minimum point 196 of the curve 190 occurs precisely when a corner is wrapped at the completion of wrapping a side of a load. Each maximum point 198 of curve 190 occurs after the minimum point 196 occurs and before the film web characteristics are locked in for the side when a subsequent corner is encountered. Thus, it can be appreciated that the final level of force 196 is significantly less than the maximum force level 198, during the prior art wrapping of any side of the load.

Figure 6:
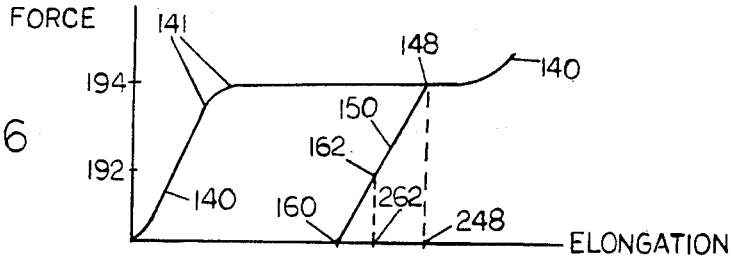
FIG. 6 in a generalized graph of force versus elongation for film web utilized in the present invention.

Turning now to FIG. 6, a general stress-strain curve 140 is shown which illustrates the relationship between elongation and force for a generalized film web composition. The curve region indicated at 141 is generally known as the elastic limit or yield point for the material. If, starting with no elongation, the material is stretched by a force which is sufficient to elongate the material no further than the region indicated at 141, then when the force is removed the material will return along the same curve 140 back to zero elongation at zero force. However, if force is exerted to carry the elongation of the film web beyond the region indicated at 141, such as to the point indicated at 148, then the film web has exceeded its elastic limit and reaches elongation point 248. It will remain permanently elongated to some extent depending upon the subsequent pattern of force applied. If the subsequent force is reduced, then elongation will recover along a curve such as that shown at 150, reaching finally a point 160 where permanent elongation is exhibited without any force whatsoever. It can be appreciated that the point 160 is to be avoided in film wrapping because this represents zero containment force experienced by the load. At such a point, then, the wrap sits loosely on the load and subsequent vibration or motion can cause contained units to spill out of the wrap.

The point 148 in FIG. 6 is reached at each maximum point 198 of the curve of FIG. 5. At these points, the force experienced by the load and the web is at a level indicated at point 194 and film elongation is at point 248. When the wrap of the side is completed, however, the force is reduced to the minimum level 192, which corresponds to the point 162 on curve 150 of FIG. 6 and elongation level 262. Thus, in the prior art constant-speed pre-stretch systems, maximum containment force to the load is forfeited. Any reduction in load circumference after wrapping, such as is commonly experienced due to settling, allows further reduction from elongation level 262 ultimately to the point 160, where no containment force is exerted. This point can be reached with a relatively modest circumference reduction from point 262, typically on the order of ten percent.

In contrast, the preferred embodiment of the present invention advantageously exerts a wrapping force to a load as well as on the film web between the load and the pre-stretch mechanism which approaches curve 300 illustrated in FIG. 10, which is a flat line. Thus, there is reduced swing between minimum and maximum points in the force curve, and the force curve can easily be elevated to lock in elongation and force to the load at a point 148 on curve 140 of FIG. 6 above the elastic limit region 141. It can be appreciated that, for a load wrapped with the present invention, extreme load circumference reduction would have to occur before containment force were relaxed to the point 160 illustrated in FIG. 6. If the force of the prior art mechanism as illustrated in FIG. 5 were merely raised so that both the maxima 198 and the minima 196 were higher, there is a substantial risk that the maxima 198 will exceed the force point at which film destruction occurs. However, the performance of the present invention elevates and flattens the load force curve so that the force to the load closely approaches the film destruction point without any risk of exceeding it.

The force curve can also be easily depressed to wrap delicate loads at low wrapping force without risk of a variation eliminating containment force completely.

Typical films which can be used in the stretch wrapping apparatus are EVA copolymer films with a high EVA content such as the films manufactured by Consolidated Thermoplastics "RS-50", Bemis "Super-Tough", and PPD "Stay-Tight" films. PVC films such as Borden Resinite "PS-26" can be used in the invention along with premium films such as Mobil-X, Presto premium and St. Regis which utilize a low pressure polymerization process resin manufactured by Union Carbide and Dow Chemical Company. This resin, called linear low density polyethylene, has significantly different stretch characteristics than previous stretch films. These characteristics allow the film to withstand the high stress of extreme elongation without tearing during wrapping of the load.

It should be noted that film, film material and film web are used interchangeably throughout the specification.

Turning to FIGS. 1 through 3, supply speed control mechanism 90 comprises a pulley frame 39 parallel to ring member 44 fixed to frame 42, and a plurality of double-sheave pulleys 62 rotably mounted on shafts 63 journalled to frame 39. The frame 39 comprises horizontal members 172 defining lengthwise slots 173, and vertical members 174 defining lengthwise slots 175. Bolts 176 are placed through slots 173 and 175 to adjustably retain members 172 and 174 in a particular orientation as will be set forth more fully below. Shafts 63 may be threaded at a frame end and locked with threaded nuts into a particular spacing in slots 174. The shafts 63 are placed so that they define corners of a polygon having an aspect ratio equal to that of a load cross-section. The term "aspect ratio equal" here means identical length ratios of adjacent sides and identical edge angles therebetween. Two polygons having equal side ratios and equal edge angles are said to have identical aspect ratios even though one may enclose greater area than another. It will be appreciated that the illustrated form of frame 39 permits easy adjustment to accomodate variation in load cross-section. Although four pulleys 62 and a rectangular frame 39 are shown in the drawings, this number is exemplary only and any appropriate number of pulleys and sides may be utilized. A power belt 64 passes around an outer sheave 65 of each pulley 62, and a drive belt 66 passes around an inner sheave 67 of each pulley 62. Belts 64 and 66 may comprise chains, belts or other well-known equivalents. If chains are utilized then the sheaves are replaced by coaxial gears.

A power pulley 68 mounted on power axle 61 across ring member 44 engages belt 64 so that rotation of ring member 44 relative to belt 64 causes pulley 68 and axle 61 to rotate in an opposite direction at a speed which varies in each revolution of ring member 44 due to passage of belt 64 around pulleys 62. Drive belt 66 also engages drive pulley 78 mounted to a rotating output shaft of drive motor 81, so that belt 64 is driven by motor 81 and the speed of motor 81 may be adjusted to increase or decrease the rate of relative rotation between belt 64 and ring member 44 without affecting the rotation rate of ring member 44 relative to the load.

The film web is drawn from roll 56 through a pre-stretching or elongation mechanism 70 and is tucked or fastened underneath or held adjacent the load. The pre-stretching mechanism 70 which is best seen in FIG. 2, comprises connected roller members 72 and 74 which are rotatably mounted respectively on shafts 73 and 75 which are in turn journalled to a housing 76. The housing 76 is mounted to and across the plane of the ring member 44. Gears 77 and 79 are mounted respectively to shafts 73 and 75, and mesh together and are driven by the supply speed control mechanism 90 as the film web engages the rubber roller surfaces. The film web passes first across the upstream roller 72 and then across the downstream roller 74 as it is pulled from film roll 56 to the load 24, and the gears 77 and 79 operate as an elongation control to rotate downstream roller 74 faster than the upstream roller 72, causing the film to be accelerated and stretched in a narrow space 80 between the two rollers. The ratio of the gear 77 to the gear 79 preferably ranges from 3:2 to 4:1, so that downstream roller 74 rotates faster than upstream roller 72 be a ratio ranging from 3:2 to 4:1. While a two-roller elongation system is preferred, it is an obvious modification to utilize any number of rollers therein, including a single roller pulling against a restrained film roll.

Film roll 56 can be urged against upstream roller 72 in any well-known conventional manner such as by a coil spring (not shown), which maintains friction of upstream roller 72 and film roll 56 as film payout reduces the diameter of film roll 56. Contact of roller 72 and roll 56 prevents uncontrolled payout of film web due to momentum of film roll 56 upon deceleration of roller 72 during normal operation.

Alternatively a pivoting collar 83 may be placed around upstream roller shaft 73, and a counterweight 85 and contact frame 84 may be mounted at angles to the collar 83. At an end of frame 84 opposite the collar 83, a contact roller shaft 51 is rotatably journalled to frame 84. Contact roller 57 is mounted to an end of shaft 51 adjacent roll 56 for engagement with roll 56. Contact roller pulley 53 is mounted to an end shaft 51 opposite roller 57. An upstream pulley 55 is mounted to shaft 73. Pulleys 53 and 55 are engaged by pulley belt 59, and the ratio of pulley sizes and the circumference of roller 57 are chosen such that the linear surface speed of roller 57 is slightly less than the linear speed of upstream roller 72. A coil spring 86 is coupled to frame 84 and housing 76 so as to constantly urge contact roller 57 against the surface of film roll 56 which decreases in radius as film web 58 is paid out during wrapping. Spring 86 forces roller 57 to maintain contact with the surface of roller 56 during rotation of ring member 44. Counterweight 85 exerts leverage on frame 84 to compensate for the effect of the force of gravity on roller 57 as ring member 44 rotates. Therefore, friction between roller 57 and film roll 56 will be maintained, and pay out speed of film web 58 from roll 56 will accelerate and decelerate precisely to match speed changes of the elongation system.

Shaft 61 extends through housing 76 a distance at least equal to the distance between rotary ring 44 and pulleys 62 for interaction with supply speed control means 90. A power pulley 68 is mounted on the end of shaft 61 so as to engage belt 64 as ring member 44 rotates. Contact of pulley 68 and belt 64 is maintained throughout the revolution of ring member 44, and tension on belt 64 is maintained by pressure of tensioner roller 69, which is spring-loaded in any wellknown conventional manner. Belts 64 and 66 are preferably made of rubber or another material with resilience and a high coefficient of friction against the material of pulleys 62 and 68, which is preferably metal.

An end of shaft 61 opposite that to which pulley 68 is mounted extends beyond the housing 76, and transfer pulley 21 is mounted thereto. An end of downstream roller shaft 75 likewise extends beyond the side of housing 76 where pulley 21 is mounted, and downstream roller pulley 25 is mounted to it. Transfer belt 23 engages pulleys 21 and 25, so that downstream roller 74 is driven to rotate at a speed proportional to that of pulley 68 via shaft 61, pulley 21, belt 23 and pulley 25.

Reduced variation in force to the load is achieved because the film supply rate from the pre-stretch mechanism 70 varies precisely as the film demand rate to the load varies, so that the net acceleration difference between the rates is constant. The film supply rate is controlled by the rate of passage of belt 64 across pulley 68, which varies as belt 64 encounters each pulley corresponding to a load corner. Because the load 24 and the pulleys 62 share a common aspect ratio, the speed of belt 64 varies precisely as shown in FIG. 5 for the same reasons, illustrated in FIGS. 7 through 9, that the film demand rate varies along the curve shown in FIG. 5. That is, the portion of belt 64 trailing from pulley 68 is demanded or pulled away by pulleys 62 at a rate which varies according to the changing effective wrapping radius around pulleys 62, just as the film is pulled away from pre-stretch mechanism 70 to the load 24 at a rate which varies according to the changing effective wrapping radius around the load. As illustrated, the film supply rate changes from a minimum to a maximum and back four times per dispenser revolution about a load of rectangular cross-section, but other configurations of pulleys 62 can be used with equal effectiveness for loads of other cross-sectional shapes. Thus the pulleys 62 and belt 64 of supply speed control means 90 serve as a predetermined model of the load 24 which controls the output rate of pre-stretch mechanism 70 without reliance on feedback through film web between roller 74 and the load. So long as the angles and ratios of side lengths remain equal for the pulley 62 area and the load cross-section, the demand rate for belt 64 will follow the load demand rate for film 58.

Figure 13:
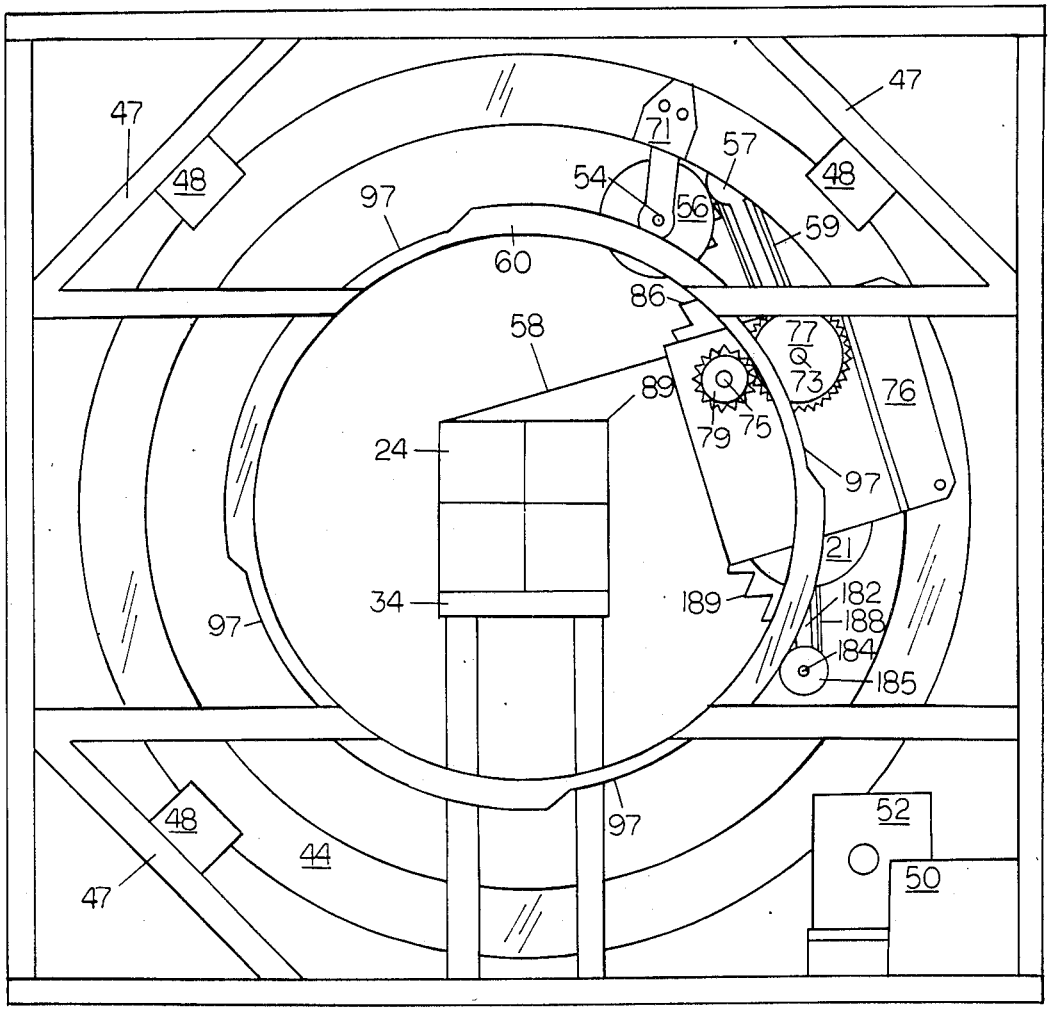
FIG. 13 is an enlarged rear elevational view of the apparatus of FIG. 12.
Figure 14:
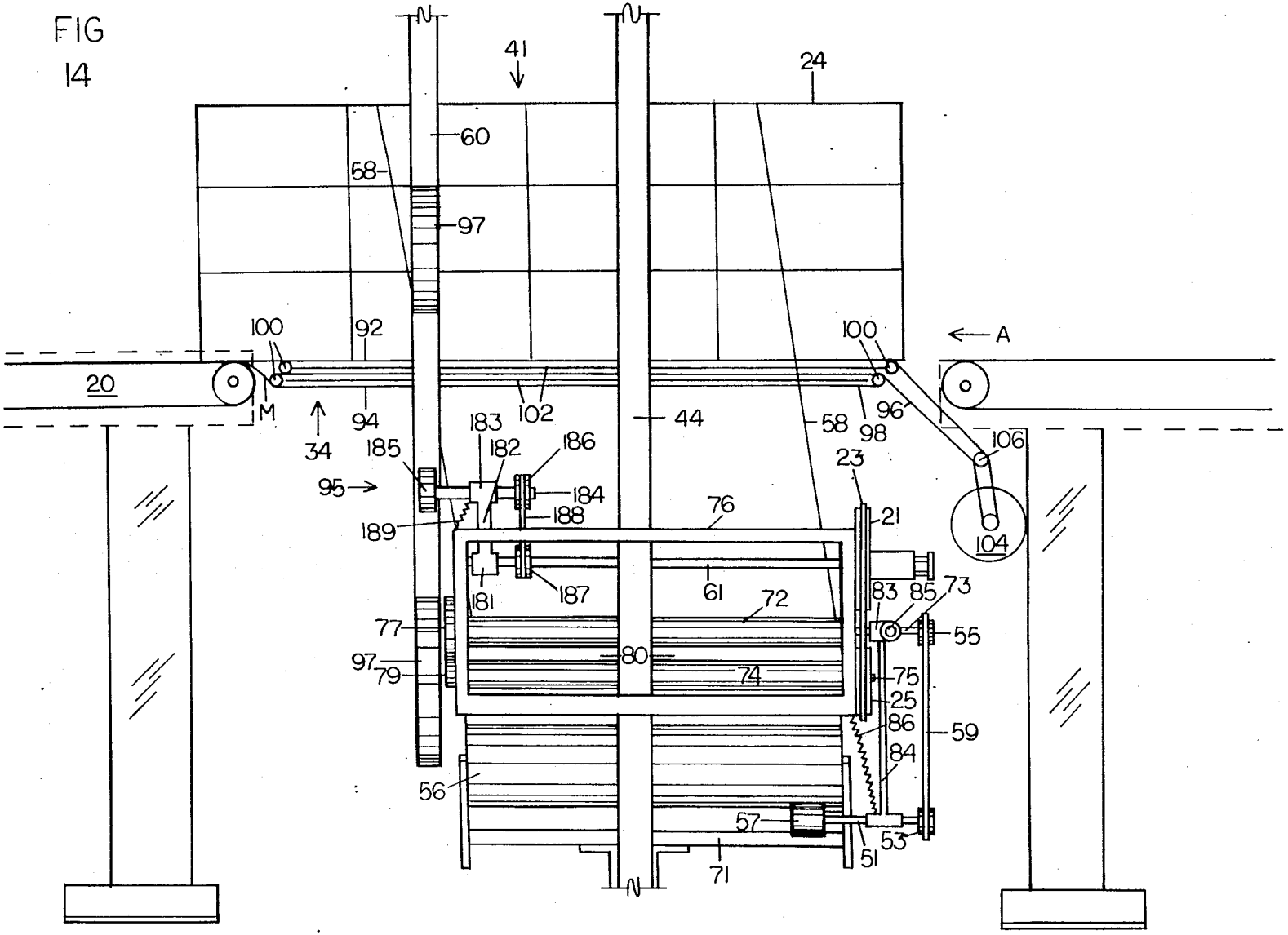
FIG. 14 is an enlarged reversed side elevational view of the apparatus of FIG. 12.

An alternate embodiment of the supply speed control mechanism designated 95 is illustrated in FIGS. 12 through 14. The belt 65, motor 81, pulley 78, pulley 68, pulley 63, frame 39, pulleys 62, and tension idler 69 are omitted. In this embodiment ring or track 60 is configured as a solid surface having a series of consecutive areas of greater or lesser radius, which may be considered as cam bumps or depressions respectively. The number and spacing of depressions 97 corresponds to the number and spacings of load vertices for purposes which will become apparent below.

In the alternate embodiment a power column 182 is mounted to power axle collar 181. The column 182 extends beyond the housing 76, and a second collar 183 is mounted at an end of column 182 remote from collar 181. An axle 184 passes through collar 183 and extends to the plane of ring 60. At the end of axle 184 adjacent ring 60, a contact roller 185 is mounted to axle 184. A tensioned coil spring 189 extends from housing 76 to collar 183 in order to urge roller 185 against the surface of ring 60 during rotation of ring 44. At an end of axle 184 opposite the contact roller 185, pulley 186 is mounted to the axle 184. A second pulley 187 is mounted to power axle 61, and a belt 188 engages pulleys 186 and 187.

As ring 44 rotates at a constant speed, contact roller 185 is driven to rotate by friction against ring 60. The rotation of contact roller 185 in turn rotates axle 184, pulley 186, belt 188, pulley 187 and power axle 61. Power axle 61 acts to drive elongation and dispensation of film web 58 as described above for the preferred embodiment. However, the rate of rotation of contact roller 185 increases across each raised portion of ring 60 and decreases in each depression of ring 60, with the column 182 acting as a cam follower by pivoting about power axle 61 to maintain contact between ring 60 and contact roller 185.

Each depression 97 of ring 60 is positioned so as to reduce contact roller 185 speed and thereby minimize the supply speed $V_1$ of film web across the downstream roller 74 precisely when a corresponding edge 89 of the load is approached by the film web 58. The depth of each depression 97 is sufficient to maintain the difference between the takeup speed $V_2$ and the supply speed $V_1$ to minimize the force and elongation variations as each load edge is encountered by film web 58. Following the edge, the roller 185 encounters a plateau on ring 60, with a corresponding greater linear circumferential distance per unit of angular rotation of ring 44. The linear speed of roller 185 will increase, correspondingly increasing the supply speed $V_1$ of film web 58 leaving the downstream roller 74. Thus the alternate embodiment achieves the desired effect of uniform acceleration, elongation and force at each load edge to lock in containment on each side of the load. As illustrated, the alternate embodiment decelerates and accelerates the speed $V_1$ of film web 58 four times per revolution of the system about a load of rectangular cross-section, but other patterns of depressions 97 could be used with equal effectiveness for loads of other cross-sections. Thus the ring 60 comprises a predetermined model of the load which controls the output rate of pre-stretch mechanism 70 without reliance on feedback through film web between roller 74 and the load.

The wrapping conveyor assembly 34 as best seen in FIG. 14 comprises two stacked conveyors 92 and 94. As more fully described in U.S. Pat. No. 4,317,322, assigned to Lantech, Inc., incorporated herein by reference, these conveyors comprise driven endless belts 96 and 98 mounted on a plurality of rollers 100. The rollers are supported by plates 102 secured in turn to a frame member (not shown) which holds the rollers in a rotatable position. The upper surface of endless belt 96 is rotated in a direction shown by the arrow A and the lower surface of belt 96 frictionally engages the top surface of endless belt 98 to drive it at the same speed. Belt 96 is driven by a motor assembly 104 which is connected by linkage 106 in the form of chains or belts to drive the conveyors. The upper belt segment of conveyor 92 travels downstream with the lower segment travelling upstream. The upper belt segment of conveyor 94 travels upstream while the lower segment travels downstream. The upper and/or lower conveyor can comprise multiple belts.

This construction allows a web of film to be wrapped around a load 24 which was carried from the infeed conveyor 32 onto the wrapping station 41. The stretched wrap of web is wrapped around the conveyor assembly 34 and the load with both the load and wrap being carried by the conveyor assembly in the same direction. In the full web, spiral and banding modes, the conveyor assembly and wrapping ring is stopped, the clamp apparatus 88 clamps the film web and the cutter mechanism 110 severs the film web. The conveyor assembly 34 is activated carrying the load and the wrap downstream to a take-off conveyor 20. When the load encounters the take-off conveyor 20 as shown in FIG. 14, the elongated stretched web coming off of the end of the conveyor assembly assumes its memory position M against the load in the space between the conveyor assembly 34 and take-off conveyor 20, allowing the contained load covered by stretched wrap to be carried away.

Figure 15:
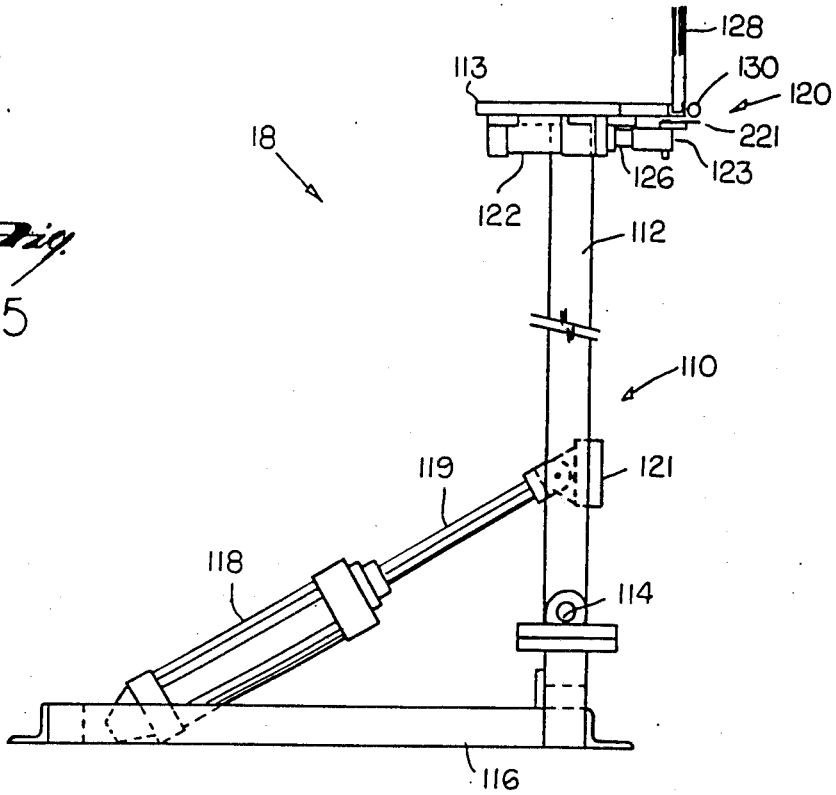
FIG. 15 is a side elevational view of the cutting apparatus of FIG. 11.
Figure 11:
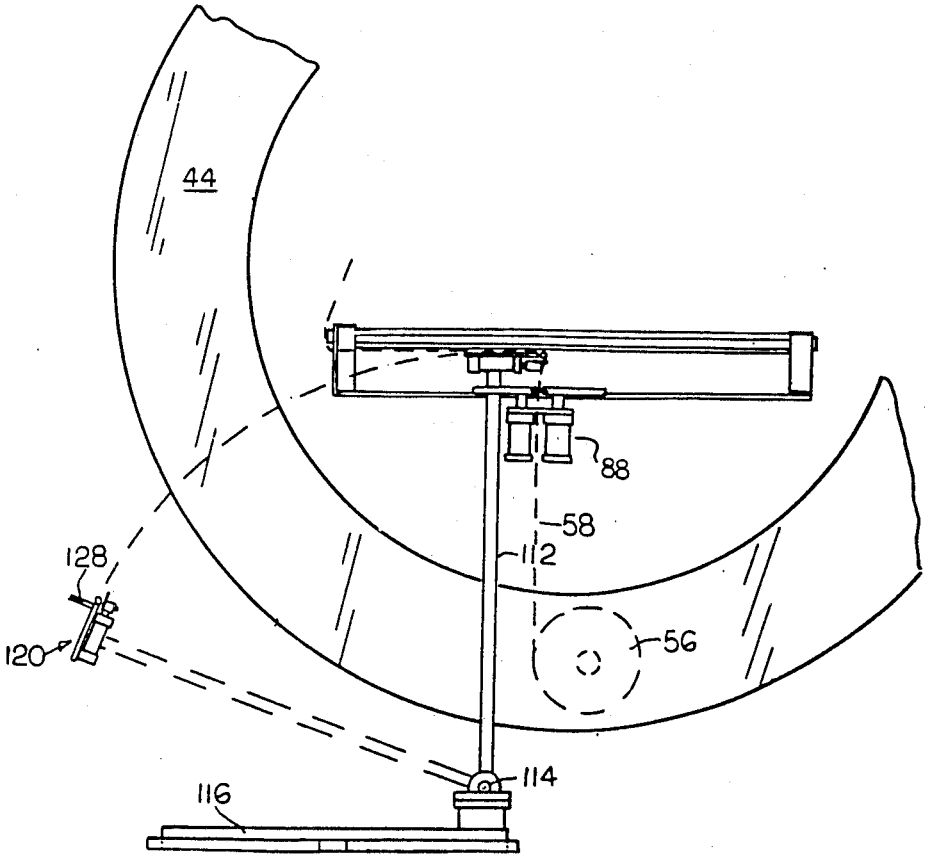
FIG. 11 is a front elevational view of the web cutting mechanism shown in various positions during cutting of the film web.

As shown in FIGS. 11 and 15, the cutting mechanism 110 used in the preferred embodiment of the invention comprises a driven pivoted standard which is adapted to project upward to engage the film web between clamping apparatus 88 and the load 24. The cutting mechanism 110 comprises a support standard 112 which is pivotally mounted at 114 to a base member 116. The base member 116 can either be a part of frame 42 or be secured to frame 42. A pneumatic lifting cylinder 118 has one end mounted by a suitable ear or bracket attachment to the base member 116 with the end of its piston rod 119 attached to the support standard 112 by suitable means such as a yoke member 121. Upon activation of the pneumatic cylinder, the upright standard 112 is transported in an arcuate path into the film web 58. Mounted to the support standard is a cutting assembly 120 comprising a support plate 113, a pneumatic cylinder 122 mounted to the support plate 113, and a cutting blade assembly 123 mounted to the piston rod 126 of cylinder 122. A brush 128 is vertically mounted on the support plate to brush down the trailing edge of the web against the conveyor assembly. A bumper member 130 is positioned in front of brush 128 to protect the brush base from initial contact with the film web and conveyor assembly. Upon appropriate activation, as for example a predetermined number of revolutions of the ring member, which is sensed by an appropriate sensor device, the cutting mechanism 110 is propelled upward so that the cutting assembly 120 engages the film web. The blade assembly 123 subsequently severs the film web from the load. If desired, the cylinder 118 can be activated after cutting to propel the standard 112 forward a predetermined distance causing the brush 128 to engage the remainder of the trailing edge of the film web and wipe it against an underlying film layer.

The conveyor assembly 34 leads from the infeed conveyor 32 to a take-off conveyor 20 which is constructed like the infeed conveyor and runs at the same speed as the infeed conveyor. In order to control both conveyors at the same rate of speed, a suitable mechanical means (not shown) is set up to make the drive of both the infeed conveyor and the take-off conveyor equal to the reduction gearing assembly of the drive motor. Thus, if the motor slows down or speeds up to drive the wrapping mechanism at different speeds, the infeed and take-off conveyors are simultaneously speeded up or slowed down so that the load is moved to conveyor assembly 34 and taken away from the conveyor assembly 34 at consistent relative speed.

In an alternate mode of wrapping, continuously wrapped loads are taken off of the apparatus and are severed into separate loads away from the apparatus. In this embodiment, the take-off conveyor 220 carries the continuously sprial wrapped loads as shown in FIG. 4 connected together by the film overwrap from the wrapping station. The take-off conveyor assembly 220 carries the spirally wrapped bundle onto cutting conveyor 222.

The wrapped spiral bundle 224 as seen in FIG. 4 is severed into individual packages by a guillotine-like cutting apparatus 225 comprising a frame 227 and a cutter mechanism 229 slideably mounted to the frame. The cutter mechanism 229 consists of a bow frame 230 strung with nichrome wire 232 which is electrically connected to a source of energy. The resistance of the wire causes sufficient heat so that when the wire is reciprocated between the encapsulated loads 224 to cut them apart, the film material is simultaneously bonded to the edges so that the film will not unravel in shipment. As the continuously-wrapped bundle 224 enters the cutting area, a sensor 131 projects a light source through the transparent film in a space S between the individual loads against a reflector 133 to generate an electrical signal commanding the cutter blade drive circuitry to activate a pneumatic cylinder 236. Upon activation, the hot cutter wire 232 is driven through the film to sever the load 124 from the wrapped spiral bundle 224. Such sensing apparatus are well known in the art, and any standard circuit can be used to cause the pneumatic cylinder 236 to be activated when the sensor senses a space between loads 124. Likewise, a limit switch, contact switch, pressure sensitive switch or other suitable means can be used to activate the cylinder 236.

The wire is heated by connection to a current source of about nine volts which heats the wire sufficiently so that the edges of the film are bonded to form a holding edge. The severed edge stretches back to its original memory shape to form the holding shape. The spiral bundle advances and the next spacing S between the loads 124 is sensed by the light sensor 131.

Other cutting apparatus can be used in place of the heating cutting wire, namely a knife blade with sawtooth edges secured to the frame in place of the cutter wire. When the blade is driven against the film, the cutting edge strikes the wrapping material substantially causing the wrapping material to shear. The cutting is done while the wrapped bundle is being transported by the conveyors.

In the operation of the preferred embodiment of the inventive wrapping apparatus, the predetermined load model is first configured by positioning horizontal members 172, vertical members 174 and pulleys 62 to define a polygon having an aspect ratio equal to that of a cross-section of the load. In the alternative embodiment, a ring 60 is configured with depressions positioned to decelerate downstream roller 74 as the film web approaches each edge of the load. The full web, spiral web, and banding modes of operation are operated in a substantially identical manner. In these modes, feed conveyor 32 brings the load 24 onto the wrapping conveyor assembly 34 which then carries the load to a predetermined wrap position within the film dispensing path and the conveyor assembly stops, leaving the load in a stationary position. The leading edge 57 of the film web 58 is held in clamping assembly 88 located beneath the conveyor assembly 34 as is best seen in FIG. 3. Rotation of ring 44 about the load is then begun.

As ring 44 rotates, the contact of belt 64 with pulley 68 forces pulleys 68 and 59 to rotate at a speed which varies as belt 64 changes position with respect to pulleys 62. Pulley 59 rotates belt 55, which in turn drives pulley 57 and downstream roller 74 on shaft 75. Film is drawn from film roll 56 across the surface of roller 74 to encircle the load. Thus, the rotation speed of roller 74 is independent of changes in the linear speed of the film web being wrapped on the load. Through gears 79 and 77, the rotation speed of upstream roller 72 is held to a constant ratio of that of downstream roller 74, so that when upstream roller 72 contacts film roll 56 and engages the film web, the film web is stretched during passage between the rollers due to the speed differential therebetween. Thus, the wrapping force changes experienced by the load in its effort to draw film across upstream roller 72 and downstream roller 74 are reduced, and the variations in speed of the film web due to edge passage on the load do not change wrapping force on the film.

After at least one wrap has been made around the load and the clamp assembly, the film edge which is held by the film web may be released. If the wrap is for a full web load as shown in FIG. 16 or a banded load as shown in FIG. 17, a plurality of overlying layers of film are wrapped around the load and the conveyor assembly 14. In the spiral wrap mode as shown in FIG. 18, a plural number of wraps are wrapped around the downstream end of the load as shown in phantom in FIG. 18 in the same manner as the banding in FIG. 17 and the conveyor assembly is activated carrying the load downstream to a take-off conveyor so that a spiral wrap is formed around the load. When the load reaches a station where the end is sensed by a feeler gauge, light sensing means, pressure sensitive switch or other suitable sensing mechanism, both the take-off conveyor and wrapping conveyor assembly stop and a second band is placed around the upstream end of the load in the same manner as if a band or full web wrap were being wrapped around the load. It should be noted that there is a space between the conveyor assembly 34 and the take-off conveyor 20 allowing the stretched film web to be discharged from the conveyor assembly and assume its memory position M around the load.

The end of the wrap cycle is determined in the present invention by a proximity switch 99 located a short distance away from ring 44 which senses a bent metal plate 45 secured to the ring. The proximity switch is electrically connected to a counter which is activated to determine each revolution of wrap. The particular counter which is utilized is an Eagle counter, Model D2100-AG, which is an off-the-shelf standard apparatus. When the counter has indicated a predetermined number of revolutions determined by the type of wrap and the load desired to be wrapped, the counter activates a switch which stops the take-off conveyor and wrapping conveyor assembly for cutting of the film web. The activation of the fluid cylinders to fire in a predetermined order and extend a predetermined distance is well known in the art and can be accomplished by common fluid circuitry. When the cutter mechanism is activated, the cutter standard and head is directed upward and abuts the film carrying the film to the middle of the load. It should be noted that the dispensing roll 56 on ring 44 in the stop position is located underneath the load and is substantially perpendicular to the axis of the load. When the film roll has been positioned in this manner, the web itself has engaged either the load edge or conveyor assembly edge and is angled from the edge down towards the roll positioned on the ring. The cutter mechanism 110 when driven upward by the pneumatic cylinder 118 engages the angled film web and carries it into substantial conformance with a perpendicular line drawn from the center axis of the conveyor assembly with the brush 128 brushing the film down over an underlying film layer wrapped around the conveyor assembly as is shown in FIG. 11. The clamping mechanism 82 is then rotated to clamp and hold the film web between the cutter head 120 and the dispensing roll 56. The pneumatic cylinder 122 of the cutting head is then fired, driving a sawtooth cutter blade 221 into the film web 58 to sever the film web. When the film web is severed, a small portion of the trailing edge is left hanging free from the wrap. If desired, this film edge may be wiped onto the load by firing the cutter standard cylinder 118 a second time so that the standard moves a short distance further on carrying the brush on to wipe the remnant edge against the wrap. The cutter standard is then withdrawn away from the load into arest position as shown in phantom in FIG. 11 for the next cutting operation and the conveyors are activated to carry the wrapped load away from the wrapping station and a new load into the wrapping station.

In the continuous wrapping operation, the previously described cutter mechansim is not used and the loads are continuously carried along the wrapping conveyor assembly onto a take-off conveyor which spaces the loads for severing downstream. The loads are then severed between the spaced film areas as previoulsy discussed and taken away to another transport area.

It can readily be appreciated that the present inventive system provides the capability to wrap loads with minimal variation in wrapping force and levels of elongation despite substantial variation in load demand for film. As a result, the user can elect to apply maximum force for high containment without risk of film failure, or to apply minimum force for delicate loads without risk of load failure or wrap loosening. Also, the system continues to operate at normal speed when film web holes develop, so that web tension changes do not cause holes to enlarge. All of these characteristics contribute to the high reliability, throughput and economy of the present inventive system.

In the foregoing description, the invention has been described with reference to a particular preferred embodiment, although it is to be understood that the specific details shown are merely illustrative, and the invention may be carried out in other ways without departing from the true spirit and scope of the following claims.

What is claimed:

1. An apparatus for wrapping a film web around a load with a cross-section which causes variations in demand rate for the film web during wrapping, comprising:

a frame;

dispenser means mounted on the frame for revolving around the load, and having at least one feeding roller for dispensing the film web; and supply speed control means rotatably coupled to the roller through a mechanism other than the film web for increasing and decreasing the rotation speed of the roller, said supply speed control means comprising means defining a predetermined model substantially approximating the cross-sectional configuration of the load for rotatably controlling the speed of the roller in response to input from said load model, said input being independent of both actual sensed variations in the tension of the film web and actual sensed variations in the demand rate for the film web downstream of the roller, said supply control means dispensing the film web from the roller at a controlled variable supply speed according to said load model input independent of sensed variations in the tension of the film web and sensed variations in the demand rate for the film web downstream of the roller.

2. An apparatus as claimed in claim 1, wherein the supply speed control means includes means for maintaining the difference between the controlled variable supply speed and the load demand rate for the film web at a substantially constant value during wrapping.

3. An apparatus as claimed in claim 1, wherein the predetermined load model input is representative of idealized variations in the demand rate for the film web downstream of the downstream roller.

4. An apparatus as claimed in claim 1, wherein the dispenser means includes ring means mounted to the frame for rotation about the load, bracket means mounted to the ring means for rotatably restraining the film web, and ring drive means connected to the ring means for driving the ring means in rotation about the load.

5. An apparatus as claimed in claim 1, wherein the load is a mutliple unit load.

6. An apparatus as claimed in claim 1, further including wrapping conveyor means for transporting the load and the film web wrapped around the load during wrapping.

7. An apparatus as claimed in claim 1, wherein a cross-section of the load includes a predetermined number of sides, the supply speed control means for increasing and decreasing the controlled variable supply speed at a frequency equal to the predetermined number of sides for each revolution of the dispenser means around the load.

8. An apparatus as claimed in claim 1 including conveyor means encircled by the dispenser means for contacting the film web and transporting the load and the film web through the area encircled by the dispenser means during wrapping.

9. An apparatus as claimed in claim 1 wherein a cross-section of the load includes a predetermined number of edges and the supply speed control means includes means for maximizing the tension in the film web between the roller means and the load when the film web encounters an edge of the load.

10. An apparatus as claimed in claim 1 includng means for adjustably increasing or decreasing elongation and tension of the film web between the roller and the load.

11. An apparatus for wrapping a film web around a load with a cross-section which causes variations in demand rate for the film web during wrapping, comprising:

a frame;

dispenser means mounted on the frame for revolving around the load, for dispensing the film web, and having elongation means for elongating the film web; and supply speed control means coupled to the elongation means through a mechansim other than the film web for increasing and decreasing the dispensing speed of the elongation means, said supply speed control means comprising means defining a predetermied model substantially approximating the cross-sectional configuration of the load for controlling the speed of said elongation in response to input from said load model, said input being independent of both actual sensed variations in the tension of the film web and actual sensed variations in the demand rate for the film web downstream of the elongation means, said supply control means dispensing the film web from the elongation means at a controlled variable supply speed accoarding to said load model input independent of the sensed variations in the tension of the film web and sensed variations in the demand rate for the film web downstream of the elongation means.

12. An apparatus as claimed in claim 11, wherein the elongation means include an upstream roller, a downstream roller, an elongation control means for rotating the upstream roller at a fixed fraction of the rotation speed of the downstream roller, and wherein the supply speed control means is rotatably coupled to the upstream and downstream rollers for increasing and decreasing the rotation speed of the upstream and downstream rollers by rotatably controlling the speed of the upstream and downstream rollers in response to the input from the predetermined idealized load model.

13. An apparatus as claimed in claim 12, wherein the elongation control means includes downstream roller gear means coupled to the downstream roller, upstream roller gear means coupled to the upstream roller, the upstream and downstream roller gear means meshing together to restrain the upstream roller to rotate at a fixed fraction of the rotation speed of the downstream roller.

14. An apparatus as claimed in claim 11, wherein said elongation means stretches the film web at a constant ratio in the range of about 3:2 to 4:1.

15. An apparatus as claimed in claim 11, wherein said elongation means stretches the film web at a constant tension above the yield point of the film web.

16. An apparatus as claimed in claim 11, the supply speed control means supplying elongated film web to the load at a tension which is less than the tension exerted on the film web in the elongation means.

17. An apparatus as claimed in claim 11, wherein said elongation means elongates the film web at a constant elongation ratio above its yield point.

18. An apparatus for wrapping a film web around a load with a cross-section which causes variations in demand rate for the film web during wrapping, comprising:

a frame;

dispenser means mounted on the frame for revolving around the load, and having at least one feeding roller for dispensing film web; and supply speed control means rotatbly coupled to the roller through a mechanism other than the film web for increasing and decreasing the rotation speed of the roller, said supply speed control means comprising means defining a predetermined model substantially approximating the cross-sectional configuration of the load for rotatably controlling the speed of the roller in response to input from said load model, said input independent of actual sensed variations in the tension of the film web and actual sensed variations in the demand rate for the film web downstream of the roller, said supply control means dispensing the film web from the roller at a controlled variable supply speed according to said load model input independent of sensed variations in the tension of the film web and sensed variations in the demand rate for the film web downstream of the roller, wherein said means for defining a model includes a plurality of pulleys mounted in an arrangement in which the pulleys define vertices of a polygon with edge length ratios and angles equal to those of a cross section of the load, and power belt means encircling the pulleys and engaging the roller and increasing and decreasing the rotation speed of the roller according to the angular position of the roller relative to the arrangement of pulleys during wrapping.

19. An apparatus as claimed in claim 18, wherein the pulleys includes double sheeve pulleys and drive belt means for engaging the double sheeve pulleys, and motor means for engaging and driving the drive belt means, the drive belt means driving the pulleys, the pulleys driving the power belt means, and the power belt means driving the roller so that the roller is driven by relative rotation of the roller and the power belt means, and the drive-belt means is driven by the motor means to vary the relative rotation of the roller and the power belt means during wrapping.

20. An apparatus as claimed in claim 18, wherein the supply speed control means includes means for maintaining the difference between the controlled variable supply speed and the load demand rate for the film web at a substantially constant value during wrapping.

21. An apparatus as claimed in claim 18, wherein the predetermined load model input is representative of idealized variations in the demand rate for the film web downstream of the roller.

22. An apparatus for wrapping a film web around a load with a cross-section which causes variations in demand rate for the film web during wrapping, comprising:

a frame;

dispenser means mounted on the frame for revolving around the load, and having at least one feeding roller for dispensing film web; and supply speed control means rotatably coupled to the roller through a mechanism other than the film web for increasing and decreasing the rotation speed of the roller, said supply speed control means comprising means defining a predetermined model substantially approximating the cross-sectional configuration of the load for rotatably controlling the speed of said roller in response to input from said load model, said input being independent of both actual sensed variations in the tension of the film web and actual sensed variations in the demand rate for the film web downstream of the roller, said supply control means dispensing the film web from the roller at a controlled variable supply speed according to said load model input independent of sensed variation in the tension of the film web and sensed variations in the demand rate for the film web downstream of the roller, wherein said means for defining a model includes a stationary track mounted on the frame and generally defining a plane parallel to the plane defined by the revolution of the dispenser means, the roller including contact roll means for engaging and having its speed controlled by the track during relative rotation of the dispenser means and the track, the track including means for increasing and decreasing the rotation speed of the contact roll means and for increasing and decreasing the rotation speed of the roller according to the angular position of the roller relative to the track during wrapping.

23. An apparatus as claimed in claim 22, the speed increasing and decreasing means of the track including variations in radius for increasing the rotation speed of the contact roll means and the roller in response to an increase in the radius of the track, and for decreasing the rotation speed of the contact roll means and the roller in response to a decrease in the radius of the track.

24. An apparatus as claimed in claim 22, wherein the supply speed control means includes means for maintaining the difference between the controlled variable supply speed and the load demand rate for the film web at a substantially constant value during wrapping.

25. An apparatus as claimed in claim 22, wherein the predetermined load model input is representative of idealized variations in the demand rate for the film web downstream of the roller.

26. A process for wrapping a film web around a load with a cross-section which causes variations in demand rate for the film web during wrapping, comprising:

forming a predetermined model substantially approximating the cross-sectional configuration of the load;

revolving a film web dispenser around the load;

dispensing the film web from at least one roller in the film web dispenser to wrap the load; and controlling the rotation speed of the roller by rotatably controlling the speed of the roller through a mechanism other than the film web in response to input from said load model, said input being independent of both actual sensed variations in the tension of the film web and actual sensed variations in the demand rate for the film web downstream of the roller and dispensing the film web from the roller at a controlled variable supply speed according to said load model input independent of sensed variations in the tension of the film web and sensed variations in the demand rate for the film web downstream of the roller.

27. A process as claimed in claim 26 wherein said load model input is representative of idealized variations in demand rate for the film web downstream of the roller.

28. A process as claimed in claim 26 including decelerating the roller when the film web approaches each edge of the load.

29. A process as claimed in claim 26 including maintaining substantially constant film web tension and elongation between the roller and the load during wrapping.

30. A process for wrapping film web around a load with a cross-section which causes variations in demand rate for the film web during wrapping, comprising:

forming a predetermined model substantially approximating the cross-sectional configuration of the load;

revolving a film web dispenser and elongation mechanism around the load;

elongating the film web with the elongation mechanism in the film web dispenser;

dispensing the film web from the elongation mechanism to wrap the load; and controlling the dispensing speed of the elongation mechanism through a mechanism other than the film web in response to input from said load model, said input being independent of both actual sensed variations in the tension of the film web and actual sensed variation in the demand rate for the film web downstream of the elongation mechanism, and dispensing the film web from the elongation mechanism at a controlled variable supply speed according to said load model input independent of sensed variations in the tension of the film web and sensed variations in the demand rate for the film web downstream of the downstream roller.

31. A process as claimed in claim 30 including stretching the film web in the elongation mechanism at a constant elongation ratio above the yield point of the film web.

32. A process as claimed in claim 30 including stretching the film web in the elongation mechanism at a ratio in excess of 2:1.

33. A process for wrapping a film web around a load with a cross-section which causes variations in demand rate for the film web during wrapping, comprising:

forming a predetermined model substantially approximating the cross-sectional configuration at the load;

revolving a film web dispenser and elongation mechanism around the load;

elongating the film web between upstream and downstream rollers in the elongation mechanism of the film web dispenser by rotating the upstream and downstream rollers at a constant rotation speed ratio;

dispensing the film web from the downstream roller in the film web dispenser to wrap the load; and increasing and decreasing the rotation speed of the upstream and downstream rollers by rotatably controlling the speed of the rollers through a mechanism other than the film web and in response to input from said load model, said input being independent of both actual sensed variations in the tension of the film web and actual sensed variations in the demand rate for film web downstream of the downstream roller, and dispensing the film web from the elongation mechanism at a controlled variable supply speed according to said load model input independent of sensed variations in the tension of the film web and sensed variations in the demand rate for the film web downstream of the downstream roller.

34. A process as claimed in claim 33 wherein said load model input is representative of idealized variations in demand rate for the film web downstream of the downstream roller.

35. A process as claimed in claim 33 including maintaining substantially constant film web tension and elongation between the downstream roller and the load during wrapping.

36. A process as claimed in claim 33 including transporting the load through the wrapping area during wrapping.

37. A process as claimed in claim 33 including varying the rotation speed of the downstream roller to maximize the tension on the film web between the downstream roller and the load when the film web contacts the edges of the load.

* * * * *